United States Patent [19]

Chuilli

[11] 4,019,747

[45] Apr. 26, 1977

[54] MAGNETIC BINGO MARKERS

[76] Inventor: Antonio Chuilli, Colonial Apt., 31 Vine St., Weymouth, Mass. 02188

[22] Filed: Feb. 6, 1975

[21] Appl. No.: 547,470

[52] U.S. Cl. ..... 273/137 AE; 273/135 AD; 273/135 B

[51] Int. Cl.[2] ..... A63F 3/06

[58] Field of Search ... 273/135 B, 135 BC, 137 AE, 273/106 B, 100, 104, 135 AD, 128 R, 130 A, 136 B

[56] References Cited

UNITED STATES PATENTS

| | | | |
|---|---|---|---|
| 301,875 | 7/1884 | Fisher | 273/128 R |
| 1,605,703 | 11/1926 | Brown | 273/137 AE |
| 2,170,033 | 8/1939 | Pittinger | 273/135 BC |
| 2,192,825 | 3/1940 | Carney | 273/135 BC |
| 2,657,059 | 10/1953 | Selig | 273/144 R |
| 3,093,919 | 6/1963 | Holtz | 273/137 AE |
| 3,194,561 | 7/1965 | Schumann | 273/136 B |
| 3,610,625 | 10/1971 | Erno et al. | 273/128 R |
| 3,684,288 | 8/1972 | Grace | 273/135 AD |
| 3,921,983 | 11/1975 | Taylor | 273/135 AD |

*Primary Examiner*—Richard C. Pinkham
*Assistant Examiner*—Harry G. Strappello
*Attorney, Agent, or Firm*—Robert T. Dunn

[57] ABSTRACT

Transparent marker pieces for use on a game board such as the game of Bingo and the like contain magnetically permeable material so that they can be quickly and easily gathered up from the game board with a magnet attached, for example, to a pencil or pen used by the player and then simply wiped off the pencil and deposited in a container for the marker pieces. In the preferred construction, the magnetically permeable material in the marker does not substantially block the view through the marker of the game board beneath and so, the transparent quality of the marker is maintained.

11 Claims, 10 Drawing Figures

MAGNETIC BINGO MARKERS

BACKGROUND OF THE INVENTION

This invention relates to marker pieces for a game board and more particularly, to marker pieces for the game of Bingo and the like containing magnetically permeable material enabling the user to pick up the pieces with a magnet.

Many game boards require the game pieces be placed upon the board in selected positions to mark the position and yet not obscure the player's view of the board. For this purpose, the pieces are often made of transparent material. In games like Bingo, at some time in the game, all pieces are removed from the board and usually deposited in a container ready to be used again. Heretofore, no provision has been made for picking the marker pieces from the board and putting them into the container except by hand. In a typical Bingo game, the pieces are relatively small discs a little over half inch in diameter and less than one-sixteenth of an inch thick and they are numerous. Hence, it is sometimes irritating and time consuming for the player to manually pick them from the board and deposit them in the container.

It is an object of the present invention to provide transparent marker pieces for a board game such as Bingo and the like which can be picked up by a relatively small magnet manipulated by the player and then wiped from the magnet for deposit in a container.

SUMMARY OF THE INVENTION

Marker pieces suitable for use in a conventional Bingo game consist of transparent discs of appropriate size for the game containing magnetically permeable material. In preferred embodiments of the invention, the magnetically permeable material is a ring that is either embedded in the disc or attached to the periphery of the disc. In another embodiment, the disc contains a hole at the center and the ring is fixed inside the hole. Furthermore, the axial thickness of the ring is no greater than the thickness of the disc.

The ring configuration of the magnetically permeable material is preferred over other configurations such as a bar embedded in the disc or small pieces of metal distributed throughout the disc because, it has been found, from experience, that a simple bar magnet small enough to attach to the end of a pencil will very readily pick up marker pieces equipped with a ring and many such pieces can be held at one time by the magnet.

These and other objects and features of the invention will be apparent from the specific description of the embodiments, taken in conjunction with the accompanying drawings.

DESCRIPTION OF EMBODIMENTS OF THE INVENTION

Figure 8:
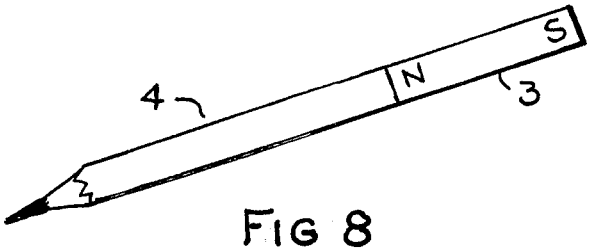
FIG. 8 illustrates a pencil or pen equipped with a magnet for picking up the markers.
Figure 7:
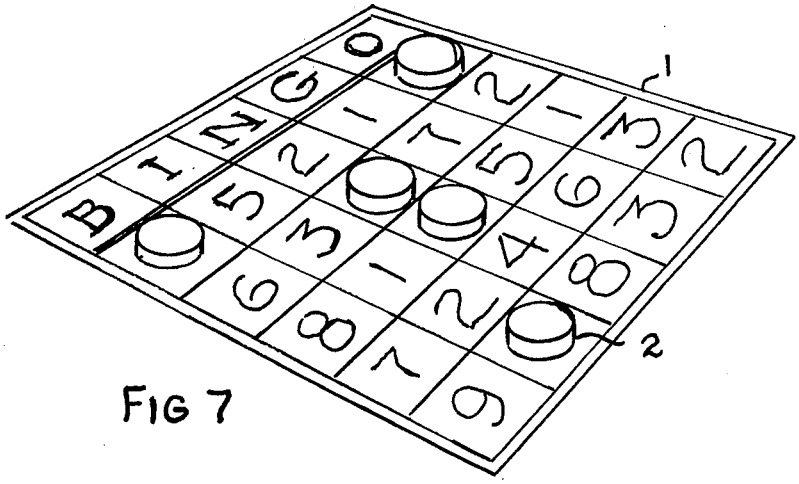
FIG. 7 shows a conventional Bingo game board with markers in place.

A Bingo game board and marker pieces are shown in FIG. 7. The game board 1 is usually between 5 to 7 inches square and provides a square matrix of 25 generally randomly numbered positions, each in a column under one of the letters of the word Bingo. As the positions are identified to the player, he picks up a marker 2 from a container and places it on the position. The marker is transparent so that the player at all times can observe the number of the position. At the conclusion of a game, the player removes all markers from the board and returns them to the container. In accordance with the present invention, each marker contains magnetically permeable material so that the player can manipulate a magnet by moving it across the board and pick up all the markers and then wipe them off the magnet depositing them in a container. Such a magnet 3 is shown in FIG. 8 attached to the end of a pencil or pen 4 that may be used by the player.

Figure 1:
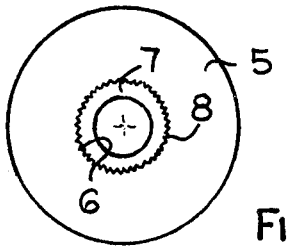
FIGS. 1 and 2 are plan and sectional views of one embodiment of the marker where the ring is mounted in a hole at the center of the marker.
Figure 2:
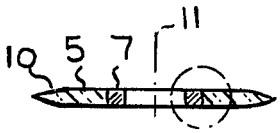

In accordance with the preferred constuction of the marker, illustrated by FIGS. 1 and 2, the marker consists of a transparent plastic disc 5 with a hole 6 at the center. Within this hole is affixed a ring 7 of magnetically permeable material such as steel to accomodate secure attachment of the ring to the disc. The outer perimeter 8 of the ring may be knurled and the outer edges of the ring at 9 are slightly beveled as shown enlarged in FIG. 2*a*.

The plastic disc 5 is preferably quickly tapered at its outer periphery 10 to facilitate picking the marker off the board with the fingers (in case a magnet is not used). Pressure by the finger at the outer periphery tends to tilt up the opposite end of the marker so that a finger can move underneath it to pick it up.

Figure 2A:
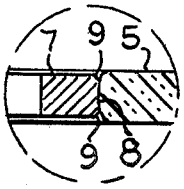
FIG. 2*a* shows an enlargement of part of FIG. 2.

The marker, as used in Bingo, is typically slightly over a half inch in diameter and less than one sixteenth of an inch thick. In the preferred embodiment shown in FIGS. 1 and 2, the axial dimension, along the axis 11 of the ring, is preferably slightly less than the thickness of the disc. As a result, the ring is slightly recessed into the marker at both faces of the marker, as shown in FIG. 2*a*. With this construction, the ring is not likely to touch the board when the marker is placed flat on the board. Also, the ring of a marker is less likely to scratch the plastic of another marker when they are mixed together and so, obscure the transparency.

Figure 3:
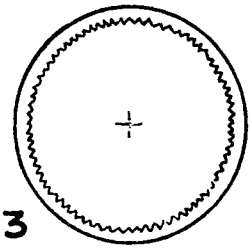
FIGS. 3 and 4 are plan and sectional views of another embodiment where the ring is mounted to the perimeter of the marker.
Figure 4:
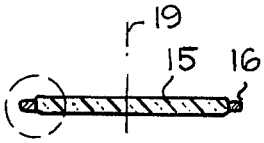
Figure 4A:
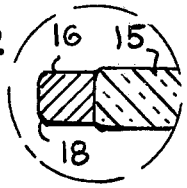
FIG. 4*a* shows an enlargement of part of FIG. 4.

Another embodiment of the marker, shown in FIGS. 3 and 4 provides a transparent disc 15 with a ring 16 of magnetically permeable material attached to the periphery of the disc. A marker made of this construction is most readily picked up by the magnet, however, there is nothing to prevent metal to plastic contact between markers when they are mixed together and so, there is a tendency for the markers to scratch each other and obscure the transparency as they are used and mixed together in the container. In this embodiment shown enlarged by FIG. 4*a*, the inside 17 of the ring 16 may be knurled to facilitate attachment to the outer periphery of the transparent disc 15 and the outside edges 18 are beveled. Here also, the actual dimension of the ring along the axis 19 is preferably less than the thickness of the disc 15 so that the ring does not touch the board when the marker lies flat on the board.

In both embodiments, shown in FIGS. 1 to 4, the radial thickness of the ring is very small and so, the ring obscures the player's view of the board very little.

As a variation of the embodiment, shown in FIGS. 1 and 2, there may be no hole at the center of the disc 5 and the ring may be entirely embedded in the disc. In that case, the marker would be manufactured by a molding process and the ring would be placed in the mold before it was filled with the transparent material of which the disc is made.

Figure 5:
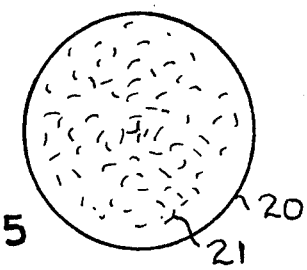
FIGS. 5 and 6 are plan and sectional views of another embodiment where the transparent marker disc contains embedded therein particles of metal.
Figure 6:
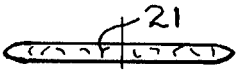

Another embodiment is shown in FIGS. 5 and 6. Here, the disc 20 is filled with particles 21 of magnetically permeable material. The size and disbursement of the particles is such that they do not substantially obscure the player's view of the board. This construction of the marker piece is generally not preferred for several reasons. First, it is less readily picked up by the magnet than the other embodiments and second, it is more costly to manufacture.

The embodiments in the present invention shown and described herein represent the best known uses of the invention. Clearly, some changes and modifications may be made to those embodiments without departing from the spirit and scope of the invention, set forth in the appended claims.

What is claimed is:

1. A marker piece for use on a game board such as the game of Bingo and the like so constructed that the piece can be picked up by the player of the game manipulating a magnet when clearing the board of a plurality of such pieces, comprising, in combination, a. a transparent disc of substantially uniform thickness and given diameter, b. a ring of magnetically permeable material, c. the axial thickness of the ring being no greater than the thickness of the disc.

d. the inside diameter of the ring being no greater than the given disc diameter, e. the ring being fixedly attached to the disc concentric therewith, and f. a magnet separate from the game board readily manipulated by the player, g. whereby the magnet held near the marker piece will pick up the piece.

2. A marker piece as in claim 1 wherein,
the ring is embedded in the disc.

3. A marker piece as in claim 1 wherein,
the disc has a hole at the center thereof and the ring is affixed to the inside of the hole.

4. A marker piece as in claim 1 wherein,
the axial thickness of the ring is less than the thickness of the disc and
no part of the ring extends beyond the thickness and diameter dimensions of the disc.

5. A marker piece as in claim 1 wherein,
the radial thickness of the ring is a small fraction of the ring diameter.

6. A marker piece as in claim 1 wherein,
the disc is made of transparent plastic material and the ring is made of steel.

7. A marker piece as in claim 1 wherein,
the thickness of the disc is no greater than a quarter of an inch and the diameter of the disc is no greater than two inches.

8. A marker piece as in claim 1 wherein,
the disc is affixed to the inside of the ring.

9. A marker piece as in claim 8 wherein,
the axial thickness is less than the thickness of the disc and
no part of the ring extends beyond the thickness dimension of the disc.

10. A marker piece as in claim 1 wherein,
the disc has a hole at the center thereof,
the ring is attached to the disc inside the hole,
the axial thickness of the ring is less than the thickness of the disc,
no part of the ring extends beyond the thickness and diameter dimensions of the disc,
the radial thickness of the ring is a small fraction of the ring diameter,
the disc is made of transparent plastic material and the ring is made of steel.

11. A marker piece for use on a game board such as the game of Bingo and the like so constructed that the piece can be picked up by the player of the game manipulating a magnet when clearing the board of a plurality of such pieces comprising in combination, a. a transparent disc of substantially uniform thickness and given diameter having a hole at the center therof, b. a ring of magnetically permeable material fixedly attached to the disc inside the hole concentric with the disc, c. the axial thickness of the ring being less than the thickness of the disc, d. no part of the ring extending beyond the thickness and diameter dimensions of the disc, e. the radical thickness of the ring being a small fraction of the ring diameter, and f. a magnet separate from the game board readily manipulated by the player, g. whereby the magnet held near the marker piece will pick up the piece.

* * * * *